US008844304B2

(12) United States Patent
Peretz

(10) Patent No.: US 8,844,304 B2
(45) Date of Patent: Sep. 30, 2014

(54) POOL HEATING SYSTEM AND METHOD

(76) Inventor: David Peretz, Haifa (IL)

( * ) Notice: Subject to any disclaimer, the term of this patent is extended or adjusted under 35 U.S.C. 154(b) by 353 days.

(21) Appl. No.: 13/105,516

(22) Filed: May 11, 2011

(65) Prior Publication Data

US 2011/0277488 A1 Nov. 17, 2011

Related U.S. Application Data

(60) Provisional application No. 61/333,421, filed on May 11, 2010.

(51) Int. Cl.

| | |
|---|---|
| ***F25B 27/00*** | (2006.01) |
| ***F25B 30/02*** | (2006.01) |
| ***F24F 5/00*** | (2006.01) |
| *F25B 47/02* | (2006.01) |

(52) U.S. Cl.

CPC ..... *F25B 30/02* (2013.01); *F25B 2700/21161* (2013.01); *F24F 5/0071* (2013.01); *F25B 47/025* (2013.01); *F25B 2339/047* (2013.01)

USPC ..... 62/238.6; 62/238.7; 62/183

(58) Field of Classification Search

USPC ..... 62/238.6, 79, 228.1, 238.7, 183, 324.1; 4/493

See application file for complete search history.

(56) References Cited

U.S. PATENT DOCUMENTS

| | | | | |
|---|---|---|---|---|
| 2,450,735 | A * | 10/1948 | Millet | 62/201 |
| 3,926,008 | A * | 12/1975 | Webber | 62/200 |
| 4,019,338 | A * | 4/1977 | Poteet | 62/238.1 |
| 4,279,128 | A | 7/1981 | Leniger | |
| 4,955,207 | A | 9/1990 | Mink | |
| 5,184,472 | A | 2/1993 | Guilbault et al. | |
| 5,415,221 | A * | 5/1995 | Zakryk | 165/283 |
| 5,560,216 | A | 10/1996 | Holmes | |
| 5,906,104 | A | 5/1999 | Schwartz et al. | |
| 6,676,026 | B1 * | 1/2004 | McKinley et al. | 236/49.3 |
| 2007/0028634 | A1 | 2/2007 | Twaddle | |
| 2011/0083450 | A1 * | 4/2011 | Turner et al. | 62/56 |

FOREIGN PATENT DOCUMENTS

DE 2349586 A * 4/1975

* cited by examiner

*Primary Examiner* — Cheryl J Tyler
*Assistant Examiner* — Ana Vazquez
(74) *Attorney, Agent, or Firm* — Hartman & Citrin LLC

(57) ABSTRACT

A pool heating system is disclosed. The pool heating system includes, in some embodiments, an immersed condenser coil. In some embodiments, the immersed condenser coil is immersed in a pool of water receiving hot refrigerant gas at high pressure from an outdoor unit, transferring heat to water in the pool, condensing the gas and transmitting condensed refrigerant to the outdoor unit. The system also includes an outdoor unit. In some embodiments, the outdoor unit includes a compressor, an expansion valve, an evaporator, and a fan.

12 Claims, 10 Drawing Sheets

POOL HEATING SYSTEM AND METHOD

CROSS-REFERENCE TO RELATED APPLICATION

This application is related to and claims the benefit of U.S. Provisional Pat. App. No. 61/333,421, entitled "Pool Heating System and Method," filed on May 11, 2010, which is hereby incorporated by reference in its entirety.

TECHNICAL FIELD

The present disclosure is generally related to heating water. More particularly, the present disclosure is directed to converting an air-conditioning unit to an indoor pool heating apparatus.

BACKGROUND

A Jewish ritual bath, called a "mikvah" in Hebrew, is a small indoor pool. A mikvah often contains between approximately 1 to 15 metric tons of water, i.e., approximately 300 to approximately 4500 gallons of water. The water in a mikvah is used for religious purposes. For religious and sanitary reasons, the water is often replaced regularly. The water is heated to a comfortable temperature, but given that a mikvah often is a community-operated pool, heating the water must be often be accomplished with limited means and/or budgets. Heating the water to comfortable bathing temperatures may require capital investment, for example, purchasing, installing, and/or operating a heating system. Moreover, using electric heating systems and/or oil- or gas-burning heating systems can carry a high operating cost for electrical or oil consumption.

The need to heat other collections of water, for example hot tubs, Jacuzzis, swimming pools, whirlpools, bathtubs, and the like can also face challenges such as those mentioned above with respect to a mikvah. With respect to swimming pools, however, these concerns may be much more pronounced. In particular, swimming pools can hold an enormous amount of water. For example, some swimming pools hold millions of gallons of water and may be located outdoors. As such, heating the water in a swimming pool may entail enormous expense.

SUMMARY

Unless otherwise defined, all technical and scientific terms used herein have the same meaning as commonly understood by one of ordinary skill in the art to which this disclosure pertains. Although methods and materials similar or equivalent to those described herein can be used or substituted in the practice or testing of embodiments of the concepts and technologies disclosed herein, illustrative suitable methods and materials are described below. It should be understood that these embodiments are illustrative, and should not be construed as being limiting in any way. In the event of any conflict with respect to terminology of this application, the patent specification including any and all definitions disclosed herein must control. Nonetheless, all materials, methods, and examples disclosed herein are illustrative of some embodiments of the concepts and technologies disclosed herein, and should not be construed as being limiting in any way.

According to some embodiments of the concepts and technologies disclosed herein, a heating system for a pool of water that is cheap to install, operate, and maintain is disclosed. In some embodiments, the heating system is obtained using a method of converting an air-conditioning unit to a pool heating system. According to one aspect of the concepts and technologies disclosed herein, a pool heating system includes an immersed condenser coil. The condenser coil is immersed in water, for example a pool of water. Heated or hot refrigerant gas is passed into the condenser coil at high pressure from a first unit, for example an outdoor unit. Heat from the refrigerant gas is transferred via the condenser coil into the water surrounding the condenser coil. The refrigerant gas in the condenser coil condenses as a result of the heat transfer, and the condensed refrigerant is returned to the first unit, e.g., the outdoor unit.

According to some implementations, the first, or outdoor, unit includes a compressor configured to compress refrigerant gas. In some embodiments, the refrigerant gas compressed by the compressor is condensed or otherwise under low-pressure, though this is not necessarily the case. In some implementations, the refrigerant gas is heated as a result of the compression, thus resulting in the heated or hot refrigerant gas at high pressure. The outdoor unit also includes, in some implementations, an expansion valve via which the condensed refrigerant is received and/or expanded, wherein the condensed refrigerant is released from the immersed condenser coil for producing low-pressure cold mixture of gaseous and liquid refrigerant, as noted above. In some embodiments, the outdoor unit also includes an evaporator configured to evaporate the cold and/or low-pressure mixture of gaseous and liquid refrigerant to produce low-pressure refrigerant gas. The evaporator also is configured to transfer or transmit the low-pressure refrigerant gas to the compressor for compression and heating. The outdoor unit also includes a fan for displacing or blowing air over or around the evaporator to assist in transferring heat from the evaporator. In some embodiments, this increases the efficiency with which the outdoor unit evaporates the low-pressure cold mixture of gaseous and liquid refrigerant.

In some embodiments, the immersed condenser coil is made of stainless steel. In some embodiments, the pool heating system further includes a thermostat for controlling the operation of the heating system by turning on and turning off the compressor, wherein the thermostat is immersed in the pool.

In some embodiments, the pool heating system further includes a reversible valve for reversing the direction of refrigerant. The reversible valve can be activated during a defrost mode, if desired. The reversible valve can be configured to direct hot and/or high pressure gas from the compressor to the evaporator and/or to direct cold and/or low-pressure gas from the condenser to the compressor. The pool heating system also can include a bi-directional expansion valve configured to expand and cool gas flowing from either or both directions. The pool heating system also can include an evaporator temperature sensor attached or connected to, or otherwise located near or at the evaporator. The evaporator temperature sensor is configured to sense a temperature of or otherwise associated with the evaporator, and to control or trigger activation of a defrost mode when a temperature of the evaporator drops below a threshold. In some embodiments, the threshold is about forty degrees Fahrenheit, about four degrees Celsius, or other temperatures.

In some embodiments the pool heating system further includes a water pump. The water pump is configured to pump and/or mix water in the pool of water. In some embodiments the compressor is a variable capacity compressor. In some embodiments the pool heating system further includes a controller for controlling a rotation speed of the fan. In some embodiments the pool heating system further includes a liquid separator for maintaining compressor intake pressure. In some embodiments the immersed condenser coil has a serpentine shape. In some embodiments the pool heating system further includes at least one additional immersed condenser coil connected in parallel to the immersed condenser coil.

According to another embodiment of the concepts and technologies disclosed herein, a method for converting an air-conditioning unit to a pool heating system is provided. The method can include operations for reversing or changing a flow direction of refrigerant in the air-conditioning unit. As such, the condenser of the air-conditioning unit can act as an evaporator. The method further includes installing the air-conditioning unit at or near a pool, for example, outside a pool enclosure. The method also includes immersing in the pool a stainless steel pipe bent to form an immersed condenser coil, and replacing the evaporator of the air-conditioning unit with the immersed condenser coil. The method also includes exchanging the thermostat of the air-conditioning unit with a thermostat immersed in the pool.

In another embodiment, the method for converting the air-conditioning unit to a pool heating system further includes the step of installing protection means to prevent electrocution. In another embodiment, the method for converting the air-conditioning unit to a pool heating system further includes operations for installing a reversible valve for reversing direction of the refrigerant during a defrost mode of operation, and installing an evaporator thermal sensor for sensing evaporator temperature of the evaporator and/or for activating the defrost mode.

It should be appreciated that various embodiments of a pool heating system according to the concepts and technologies disclosed herein may be used for heating any desired bodies of liquids. For example, the concepts and technologies disclosed herein can be used to heat swimming pools, a mikvah, a bathtub, a Jacuzzi, a hot tub, a whirlpool, and/or other bodies of liquid. Similarly, it should be understood that the concepts and technologies disclosed herein can be used to heat liquids other than or in addition to water.

As noted above, a mikvah may contain any amount of water, but typically contains approximately one to approximately fifteen metric tons of water. In one embodiment of the concepts and technologies disclosed herein, a pool heating system for heating a mikvah can provide a heating system that provides approximately one hour-power unit per metric ton of water. The pool heating system can be scaled up for larger pools of water and/or to provide a faster heating rate relative to the comparatively smaller pool heating system. For example, the pool heating system can be scaled up by scaling up the capacity of the air-conditioning unit used to provide the functionality associated with the pool heating system. Additionally, or alternatively, two or more air-conditioning units can be used to provide the functionality of the pool heating system, thus similarly resulting in improved pool heating system capacity and/or performance. It should be understood that these embodiments are illustrative, and should not be construed as being limiting in any way.

According to some embodiments of the concepts and technologies disclosed herein, cost reduction in operating pool heating systems can be realized due to the relative simplicity of the pool heating system, as well as use of common components and the reduction of parts, as will be understood by reference to the disclosure herein. In some embodiments, in contrast to most pool heating systems, a pool heating system according to the concepts and technologies disclosed herein may not require drawing the pool water into the pool heating system. Rather, natural heat conduction and convection currents within the pool can be used to help spread the heated water around the condenser coil and/or other pool heating system components to and/or through the water in the pool. As such, embodiments of the concepts and technologies disclosed herein may not require additional water circulation pumps, and as such can help realize savings with respect to installation and operation costs, as well as increased reliability relative to other pool heating systems.

According to various embodiments of the concepts and technologies disclosed herein, converting an air-conditioning unit to a pool heating system may be accomplished using relatively simple operations. Thus, the conversion can be completed in a relatively simple workshop with limited tooling and skill. Similarly, installation of the pool heating system according to various implementations of the concepts and technologies disclosed herein can be relatively simple and can require minimal modification to buildings and/or the heated pool of water. Thus, the pool heating system can be retrofitted to existing pools without requiring substantial rework of the pool and/or surrounding or associated structures. Furthermore, in contrast to oil-burning or other pool heaters, embodiments of the concepts and technologies disclosed herein may require only an electric power source. Similarly, embodiments of the concepts and technologies disclosed herein can operate without emitting smoke or gases and/or creating fire hazards.

In some embodiments, pool heating systems according to the concepts and technologies disclosed herein do not include water circulation pumps. Rather, an immersion coil of the pool heating systems can be used to achieve heating of the water in the pool. Thus, in contrast to other approaches to heating water wherein a relatively small volume of water is removed from the pool and heated to high temperature and returned to the pool to be mixed with the rest of the water, embodiments of the concepts and technologies disclosed herein can require less energy to operate, fewer moving parts, elimination of a water suction and/or returns, and more efficient heating relative to other pool heating approaches. In other heating systems, for example, water heated by the heating system may never reach temperatures substantially higher than bathing temperature due to various limitations of the heating systems.

Some embodiments of the concepts and technologies disclosed herein, however, allow chemical reactions such as corrosion and degradation of water quality or disintegration disinfectant to be avoided. Moreover, reliability of the pool heating system according to various embodiments of the concepts and technologies disclosed herein can be high relative to other heating approaches due to absence of water pump and oil or gas burning apparatuses. The system may require no scheduled maintenance and may work for a long duration of time without any regularly scheduled maintenance. In some embodiments, the pool heating system operates for over seven years without service. It should be understood that this embodiment is illustrative, and should not be construed as being limiting in any way.

As noted above, embodiments of the concepts and technologies disclosed herein also may be used for heating other bodies of water such as water tanks. Furthermore, liquids other than water can be heated. For example, the pool heating systems disclosed herein may be useful for heating flammable or corrosive liquids. These and other embodiments, features, and/or advantages of the concepts and technologies disclosed herein will be apparent from the drawings and the description contained herein.

Other systems and methods according to embodiments will be or become apparent to one with skill in the art upon review of the following drawings and detailed description. It is intended that all such additional systems and methods be included within this description, be within the scope of this disclosure, and be protected by the accompanying claims.

BRIEF DESCRIPTION OF THE DRAWINGS

Embodiments of the concepts and technologies disclosed herein are described, by way of example only, with reference to the accompanying drawings. With specific reference now to the drawings in detail, it is stressed that the particulars shown are by way of example and for purposes of illustrative discussion of various embodiments of the concepts and technologies disclosed herein only. These embodiments are presented to provide what is believed to be a useful and readily understood description of the principles and conceptual aspects of the concepts and technologies disclosed herein. In this regard, no attempt is made to show structural details of the various embodiments of the concepts and technologies disclosed herein in more detail than is necessary for a fundamental understanding of the various concepts and technologies disclosed herein. The description taken with the drawings make apparent to those skilled in the art how various implementations of the concepts and technologies disclosed herein may be embodied in practice.

DESCRIPTION

The following detailed description is directed to methods and systems for providing pool heating systems. The following detailed description is only one illustrative embodiment for carrying out the various concepts and technologies disclosed herein. This description is not to be taken in a limiting sense, but is made merely for the purpose of illustrating the general principles in accordance with the concepts and technologies disclosed herein. It should be noted that the drawings included herewith are not necessarily drawn to scale.

Figure 1A:
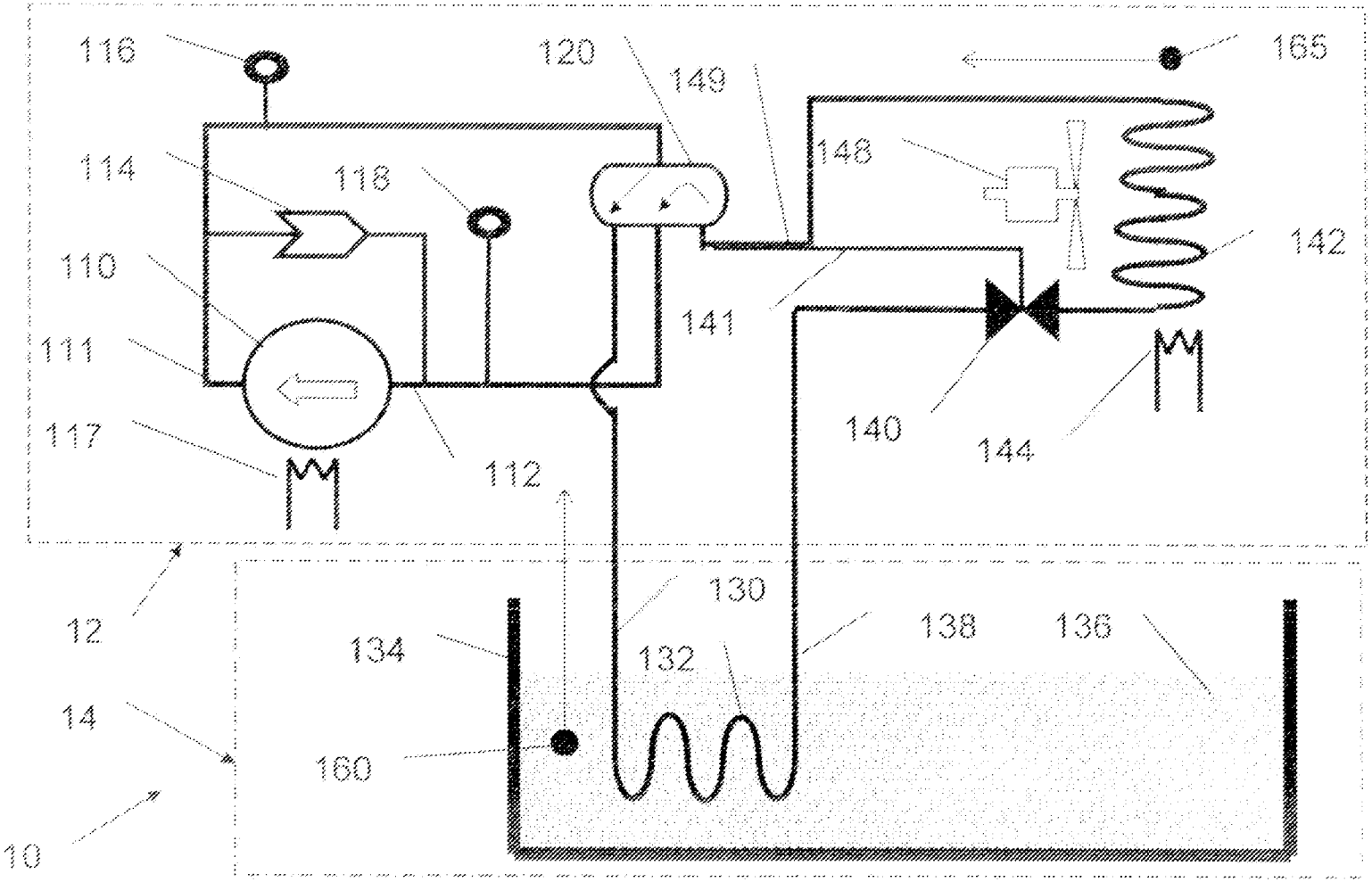
FIG. 1A is a schematic illustration of the heating system according to an illustrative embodiment.

With reference to the drawings, FIG. 1A is a schematic diagram of a pool heating system 10 according to one embodiment. In the illustrated embodiment, the pool heating system 10 includes an outdoor unit 12 supplying thermal energy for heating water 136 of a pool 134. The pool 134 can be, but is not necessarily, located inside a pool enclosure 14. In some embodiments, the pool enclosure 14 is an indoor pool enclosure. According to one embodiment of the concepts and technologies disclosed herein, the pool 134 corresponds to a ritual bath known as a mikvah in Hebrew. The mikvah can be, but is not necessarily, enclosed in a room or a building, and the outdoor unit 12 can be, but is not necessarily, installed or otherwise located outside of the pool enclosure 14, on a roof of the pool enclosure 14, and/or elsewhere. It should be understood that these embodiments are illustrative, and should not be construed as being limiting in any way.

The outdoor unit 12 can include a compressor 110. The compressor 110 is configured to compress a refrigerant gas. In some embodiments, the refrigerant gas includes, but is not limited to, Freon or other gases. The compressor 110 can operate using electric power, if desired. According to various embodiments of the concepts and technologies disclosed herein, the refrigerant gas compressed by the compressor 110 includes, but is not limited to, Freon 22, Freon 134A, R41 OA, and/or other gases. It should be understood that these embodiments are illustrative, and should not be construed as being limiting in any way.

In some embodiments, an optional compressor heating element 117 is used to maintain an operating temperature of the compressor 110 within a defined safe temperature range. In various implementations, the heating element 117 is used to maintain the operating temperature of the compressor 110 at a temperature determined to be sufficient to reduce or increase lubrication viscosity, to prevent condensation of the refrigerant within the compressor 110, and/or for other purposes. Optionally a user-activated electrical switch (not illustrated in the FIGURES) can be included. The user-activated electrical switch can be used to switch the compressor 110 and/or other components of the pool heating system 10 between a "winter" position, a "summer" position, and/or other positions to control the compressor heating element 117. The user-activated electrical switch thus can be used to activate the heater in the winter, to disconnect the heater during the summer, and/or for other reasons. It should be understood that these embodiments are illustrative, and should not be construed as being limiting in any way.

In various embodiments, a cold gas at low-pressure enters the compressor 110 through an inlet 112. In the compressor 110, the cold gas is compressed and exits the compressor 110 as hot gas at high pressure through an outlet 111. In some embodiments, a hot gas bypass valve 114 can be located and/or connected between the inlet 112 and the outlet 111. The bypass valve 114 can be used to maintain a substantially constant gas pressure difference between the inlet 112 and the outlet 111. It should be understood that this embodiment is illustrative, and should not be construed as being limiting in any way.

Optionally, a high pressure shutoff switch 116 can be located and/or connected to the outlet 111 and/or the low-pressure shutoff switch 118. The high pressure shutoff switch 116 can be used for shutting off the pool heating system 10 and/or components thereof if a pressure or pressures in the pool heating system deviate from one or more predefined or present pressure ranges and/or pressure thresholds. These optional safety measures can be used to protect the pool heating system 10 in cases of gas leaks, in cases of overpressure due to line blockages, and/or in the event of other occurrences, malfunctions, and the like. It should be understood that these embodiments are illustrative, and should not be construed as being limiting in any way.

In a normal or default heating operation mode, a hot gas at high pressure flows from the outlet 111 to the reversible valve 120. From the reversible valve 120, the high pressure hot gas flows through one or more hot gas lines 130 to an immersed condensing coil 132. In one contemplated embodiment, the reversible valve 120 is a solenoid activated valve. It should be understood that this embodiment is illustrative, and should not be construed as being limiting in any way. In FIG. 1A, arrows within the illustrated reversible valve 120 depict refrigerant flowing during normal or default heating operation modes. It should be understood that this embodiment is illustrative, and should not be construed as being limiting in any way.

The immersed condensing coil 132 can be situated at or near a bottom of the pool 134, attached to or located at or near a wall of the pool 134, and/or otherwise located in water 136 contained by the pool 134. According to various implementations of the concepts and technologies disclosed herein, heat from the high pressure hot gas is transferred to the water 136 in the pool 134. As such, various embodiments of the concepts and technologies disclosed herein allow cooling of the hot gas that condenses to a warm liquid at high pressure while also warming the water 136. As such, cooling of the high pressure hot gas can be effected while warming the water 136 to a comfortable bathing temperature, for example. It should be understood that this embodiment is illustrative, and should not be construed as being limiting in any way.

The immersed condensing coil 132 can be made from one or more non-corroding substances and/or corrosion-resistant materials. For example, the immersed condensing coil 132 can be formed from stainless steel. In some embodiments, the immersed condensing coil 132 is formed from type 316 stainless steel alloy. It should be understood that this embodiment is illustrative, and should not be construed as being limiting in any way.

In some embodiments, fins or other heat syncs are formed from a heat conducting material such as aluminum, copper, or other metals, as well other non-metal materials. In some embodiments, metal fins are welded to the immersed condensing coil 132, thus increasing surface area of the immersed condensing coil 132 and thereby enhancing heat exchanging capabilities of the immersed condensing coil 132 relative to embodiments of the immersed condensing coil 132 without fins. As such, the immersed condensing coil 132 can be used to transfer heat to the water 136, as explained above. In one embodiment of the immersed condensing coil 132, whether formed with or without the fins, fourteen meters of stainless steel tubing is bent to form the submerged condenser and the lines leading to and from the pool. It should be understood that these embodiments are illustrative, and should not be construed as being limiting in any way.

In one embodiment, the pool 134 is a small indoor pool or a ritual bath such as a mikvah. As explained above, the pool 134 can therefore contain one to fifteen metric tons or more, i.e., approximately 300 or more gallons, of water 136. It should be understood that this embodiment is illustrative, and should not be construed as being limiting in any way.

Warm or hot liquid refrigerant at high pressure can be routed to the outdoor unit 12 via an outdoor unit return line 138. Via the outdoor unit return line 138, the hot liquid refrigerant reaches a bi-directional expansion valve 140. In the bi-directional expansion valve 140, the hot liquid refrigerant expands and cools. A cold low-pressure mixture of liquid and gas enters an evaporator 142. In the evaporator 142, the liquid can be evaporated. As is generally understood, evaporating the liquid can effect heat extraction from outdoor air surrounding or being blown over the evaporator, for example, by a fan 148.

The low-pressure gas can be returned to the reversible valve 120 through a gas return line 149. Surplus gas from the bi-directional valve 120 can also be directed through a surplus gas line 141 to the gas return line 149. From the reversible valve 120, the low-pressure gas returns to the compressor inlet 112 to be compressed. As such, it can be appreciated that the low-pressure gas can return to the compressor 110 to start the cycle described above and illustrated in FIG. 1A again.

In some embodiments, a water thermal sensor 160 can be immersed in the pool 134. The water thermal sensor 160 can activate, or can be monitored to activate, the pool heating system 10 when the water temperature falls below a first lower preset temperature. Similarly, in some embodiments the water thermal sensor 160 deactivates, or is monitored to deactivate, the pool heating system 10 when the water temperature meets or exceeds a second higher preset temperature. According to various implementations, activation of the pool heating system 10 includes energizing the compressor 110 and the fan 148. Similarly, deactivation of the pool heating system 10 can include de-energizing the compressor 110 and/or the fan 148. It should be understood that these embodiments are illustrative, and should not be construed as being limiting in any way.

In some embodiments, the pool heating system 10 includes a timer (not illustrated). The timer can, but is not necessarily, used to activate or deactivate the pool heating system 10 according to a schedule. For example, the timer can be used to deactivate the pool heating system 12 regardless of temperature at night, on the Sabbath, on holidays, or the like. Optionally, a timer can be used for changing the preset temperatures used by thermostat 160. It should be understood that these embodiments are illustrative, and should not be construed as being limiting in any way.

In some embodiments, the pool heating system 10 includes an evaporator heating element 144. The evaporator heating element 144 can be used to heat the evaporator 142. For example, the evaporator heating element 144 can be used to heat the evaporator 142 on cold days or in cold conditions. An evaporator thermal sensor 165 also can be used to sense a temperature at a condenser. It should be understood that these embodiments are illustrative, and should not be construed as being limiting in any way.

In some embodiments, the pool heating system 10 includes a heater 117. The heater 117 and the evaporator heating element 144 both may be activated by or based upon the condenser thermal sensor 165. Thus, it can be understood that in some embodiments the condenser thermal sensor 165 is in thermal contact with the evaporator 142. It should be understood that this embodiment is illustrative, and should not be construed as being limiting in any way.

At some times, for example on some cold days, for example when the ambient temperature at the pool heating system 10 is cold, ice may form on the evaporator 142. For example, if the ambient temperature is four degrees Celsius or below, ice may form on the evaporator 142. In some embodiments, ice on the evaporator 142 may block or restrict airflow at or around the evaporator 142. As such, ice on the evaporator 142 can reduce an efficiency of heat transfer from the air to the evaporating gas, and therefore can reduce performance of the pool heating system 10. In these and other situations, the direction of refrigerant flow may be reversed. In some embodiments, the flow of the refrigerant is reversed for a short duration by reversing the position of reversible valve 120. It should be noted that an activation temperature setting of the evaporator thermal sensor 165 may be any temperature, and that four degrees Celsius is merely illustrative. As such, this embodiment should not be construed as being limiting in any way. This type of operation is referred to herein as a "defrost mode," as the evaporator 142 is defrosted or deiced thereby.

In this defrost mode of operation, hot high pressure gas is directed by the reversible valve 120 through the gas return line 149. The hot high pressure gas can be directed through the gas return line 149 to the evaporator 142. The hot high pressure gas can, when in the evaporator 142, cause the evaporator 142 to act instead as a condenser. As such, the hot gas can quickly melt the ice or frost layer that can form on the evaporator 142 and can also condense to a high pressure liquid. It should be understood that this embodiment is illustrative, and should not be construed as being limiting in any way.

In some embodiments, the condenser thermal sensor 165 is a dual sensor with more than one, e.g., two or more, temperature settings. For example, at about eleven degrees Celsius the heating element 144 and/or the heating element 117, can be activated, and at or below about four degrees Celsius, gas flow of the refrigerant can be reversed. It should be understood that the temperature settings may be changed, and that two sensors, each with different setting may be used. As such, it should be understood that these embodiments are illustrative, and should not be construed as being limiting in any way.

From the evaporator 142, the high pressure liquid can arrive at the bi-directional valve 140. At the bi-directional valve 140, the high pressure liquid can expand to a low-pressure gas and liquid mixture, and can flow through the line 138 to the immersed condenser coil 132. It therefore can be understood that in this mode of operation, the immersed condenser coil 132 can function as an evaporator. From the condenser 132, the low-pressure gas returns to the compressor 110 through the line 130, the reversible valve 120, and the inlet 112. It should be understood that this embodiment is illustrative, and should not be construed as being limiting in any way.

In some embodiments, the pool heating system 10 further includes elements generally known and/or understood in the art. As such, these elements have not been illustrated to avoid clouding the disclosure. Such elements include, but are not limited to, a refrigerant reservoir, a refrigerant dryer, a moisture indicator, over-pressure gas release valves, gas refilling and system evacuation valves, etc. In some embodiments, the outdoor unit 12 is housed in a weather-proof enclosure. It should be understood that this embodiment is illustrative, and should not be construed as being limiting in any way. Similarly, in some embodiments, controllers such as temperature setting devices, operational switches, timers, and the like, are located indoors. For example, in some embodiments these and other controllers are located at a room adjacent to the pool enclosure 14. It should be understood that this embodiment is illustrative, and should not be construed as being limiting in any way.

In some embodiments, the line 130 and the line 138 are grounded. Grounding of the line 130 and the line 138 can be completed to help reduce a risk of electrocution to people in or near the pool 134. In some embodiments, some, either, or both the line 130 and the line 138 may be made of non-conductive material. Additionally, some embodiments of the pool heating system 10 include one or more ground fault circuit interrupters (GFCI) and/or other shock prevention devices such as over current fuses, which can be used to provide protection against electrocution. It should be understood that this embodiment is illustrative, and should not be construed as being limiting in any way.

According to one contemplated embodiment, a method for converting a standard household air-conditioning unit into a heating unit is disclosed herein. According to one embodiment, the evaporator and condenser of the air-conditioning unit are removed. An immersed condenser is connected to the air-conditioning unit at the appropriate gas lines, as will be understood from a careful review of FIG. 1 above. In some embodiments, a reversible valve is installed. If a reversible valve already exists in the air-conditioning unit, the existing reversible value can be removed, used, or replaced. In some embodiments, the condenser of the air-conditioning unit is used as an evaporator in the heating unit. Using the condenser can help conserve space and/or reduce an amount of replace parts and rework required. Furthermore, the condenser coil of the air-conditioning unit may be smaller than the evaporator coil. As such, reuse of the condenser coil an help realize space savings.

In some embodiments, the expansion valve of the air-conditioning unit is replaced with a bi-directional expansion valve. An immersed thermostat 160 can be connected to the controller of the air-conditioning unit. The submerged thermal sensor can be configured to be fully waterproof and to pose no electrocution hazard. For example, the sensor and connecting wires may be enclosed in watertight stainless-steel or a plastic sheath. Also, additional elements such as the compressor heating element 117, the hot gas bypass 114, the high pressure shutoff switch 116, the low-pressure shutoff switch 118, the surplus gas line 141, and/or other elements can be installed. As such, an air-conditioning unit can be converted to a pool heating system 10 with relatively little rework and/or new parts. It should be understood that the above embodiments for converting an air-conditioning unit to a pool heating system 10 are illustrative, and should not be construed as being limiting in any way.

Experimentation with embodiments of the pool heating system 10 disclosed herein have shown up to a seventy-five percent (75%) reduction in power usage over traditional electrical or oil-burning pool heaters of comparable sizes. As such, embodiments of the pool heating system 10 can be used to realize substantially lower operating cost compared to conventional electrical or oil-burning water heaters. These cost savings can be realized, in part, due to the high efficiency of embodiments of the pool heating system 10. In some embodiments, for example, each kilowatt (KW) of power consumed by the pool heating system 10 has been proven to generate approximately 3.7 to 3.9 KW of heat to the water 136. More particularly, in one existing embodiment of the pool heating system 10, a pool 134 containing 1,200 liters (1.2 metric tons) of water, a single phase 14,000 BTU air-conditioning unit converted into a pool heating system 10 as described hereinabove resulted in a temperature increase of about twenty degrees Celsius in about two hours of operation. As such, this embodiment of the pool heating system 10 is capable of heating 1,200 liters of water by about ten degrees Celsius per hour, 1.2 killowatt hours. It should be understood that these embodiments are illustrative, and should not be construed as being limiting in any way.

Similarly, another embodiment of the pool heating system 10 disclosed herein was used to heat a pool 134 containing 3,000 liters (3 metric tons) of water. A three phase 49,000 BTU air-conditioning unit was converted into a pool heating system 10 as described herein. The pool heating system 10 raised the temperature of the pool water by ten degrees Celsius per hour while consuming only about 2.5 to 3 kilowatts of electricity per hour. In another embodiment, the pool heating system 10 raised the temperature of the pool water by about twenty degrees Celsius total while only consuming between five and six kilowatts of electricity. It should be understood that these embodiments are illustrative, and should not be construed as being limiting in any way.

Figure 1B:
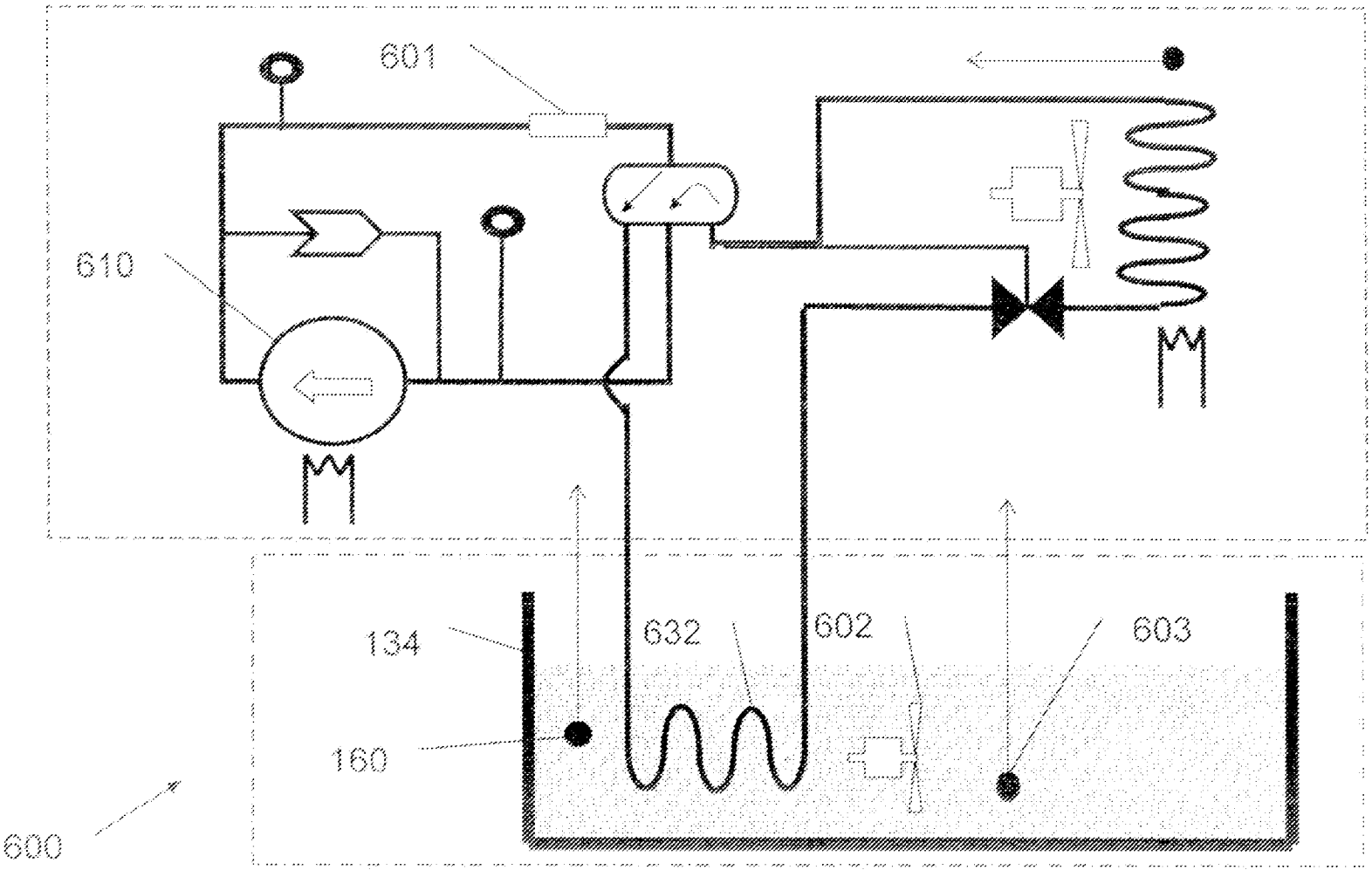
FIG. 1B is a schematic illustration of the heating system according to another illustrative embodiment.

FIG. 1B is a schematic diagram of another pool heating system 600 according to another embodiment. The pool heating system 600 differs from the pool heating system 10 of FIG. 1A by the following optional additions and modifications. The compressor 610, according to the illustrative embodiment, may be a variable capacity compressor, for example as commercially available from Bitzer (Kühlmaschinenbau GmbH, Eschenbrunnlestraβe 15, 71065 Sindelfingen, Germany), DANFOSS SM.090, MATSUSHITA COMPRESSOR CORP, Japan, and/or at least five other suppliers. In other embodiments, the compressor 610 is any suitable inverter compressor. Any suitable inverter compressor and/or methods can be substituted, if desired. In one embodiment, the compressor 610 is configured to automatically vary output according to a determined heating load needed. An immersed condensing coil 632 may be of additional configurations, as illustrated and described in FIGS. 5-6.

In some embodiments, a liquid separator and accumulator 601 may be included in the pool heating system 600. The liquid separator and accumulator 601 can be used to maintain compressor head pressure, to compensate for refrigerant expansion in different temperatures, to enhance the performance of the pool heating system 600, and/or for other purposes. The liquid separator and accumulator 601 also may be used for trapping, adding or removing oil or other liquid or contaminates circulating within or with the refrigerant. The liquid separator and accumulator 601 may be located or inserted at various locations in the refrigerant line. The suitable liquid separators and accumulators 601 are commercially available, for example, a suction accumulator from AIRMENDER REFRIGERATION PRODUCTS CO., LTD. in Taiwan can be used to provide the functionality described herein with respect to the liquid separator and accumulator 601. It should be understood that these embodiments are illustrative, and should not be construed as being limiting in any way.

In some embodiments, a water pump 602 is used to mix the water 136 in the pool 134. The water pump 602 can be a relatively small pump, propeller, or fan that can be immersed in the water 136 and situated at or near the immersed condensing coil 632. By mixing the water 136 in the pool 134, the water 136 heated by the immersed condensing coil 632 can be evenly distributed throughout the pool 134, thereby helping achieve uniform temperature throughout the pool 134. Additionally, or alternatively, the mixing can enhance the performance of the pool heating system 600 and/or increase efficiency of the pool heating system 600 by lowering the temperature at the vicinity of immersed condensing coil 632 during heating, thereby increasing the temperature potential at or near the immersed condensing coil 632. In some embodiments, the water pump 602 is not immersed. Rather, the water pump 602 can be situated outside the pool 134 and can be equipped with intake and output pipes (not illustrated in FIG. 1B). In some embodiments, openings of at least one of the intake or output pipes can be situated in proximity of the immersed condensing coil 632, while the other opening can be situated away from the immersed condensing coil 632. Generally, the pump 602 can be used for creating water circulation within the pool 134. It should be understood that these embodiments are illustrative, and should not be construed as being limiting in any way.

In some embodiments, the pump 602 is controlled by a timer (not shown in FIG. 1B). By intermittently turning on the pump, electricity can be conserved and operation costs can be minimized or at least reduced. Alternatively, a thermometer 603 can be used or relied upon for controlling operation of the pump 602. In some embodiments, reading two or more thermometers, for example the thermometer 160 and the thermometer 603 can be completed. If the readings differ by more than a preset threshold, the pump can be turned on. In some embodiments, one of the thermometers is situated near the immersed condensing coil 632, and the second thermometer is situated remotely from the immersed condensing coil 632. In other embodiments, the pump 602 is turned on during a heating cycle of the system 600. It should be understood that this embodiment is illustrative, and should not be construed as being limiting in any way.

Figure 2A:
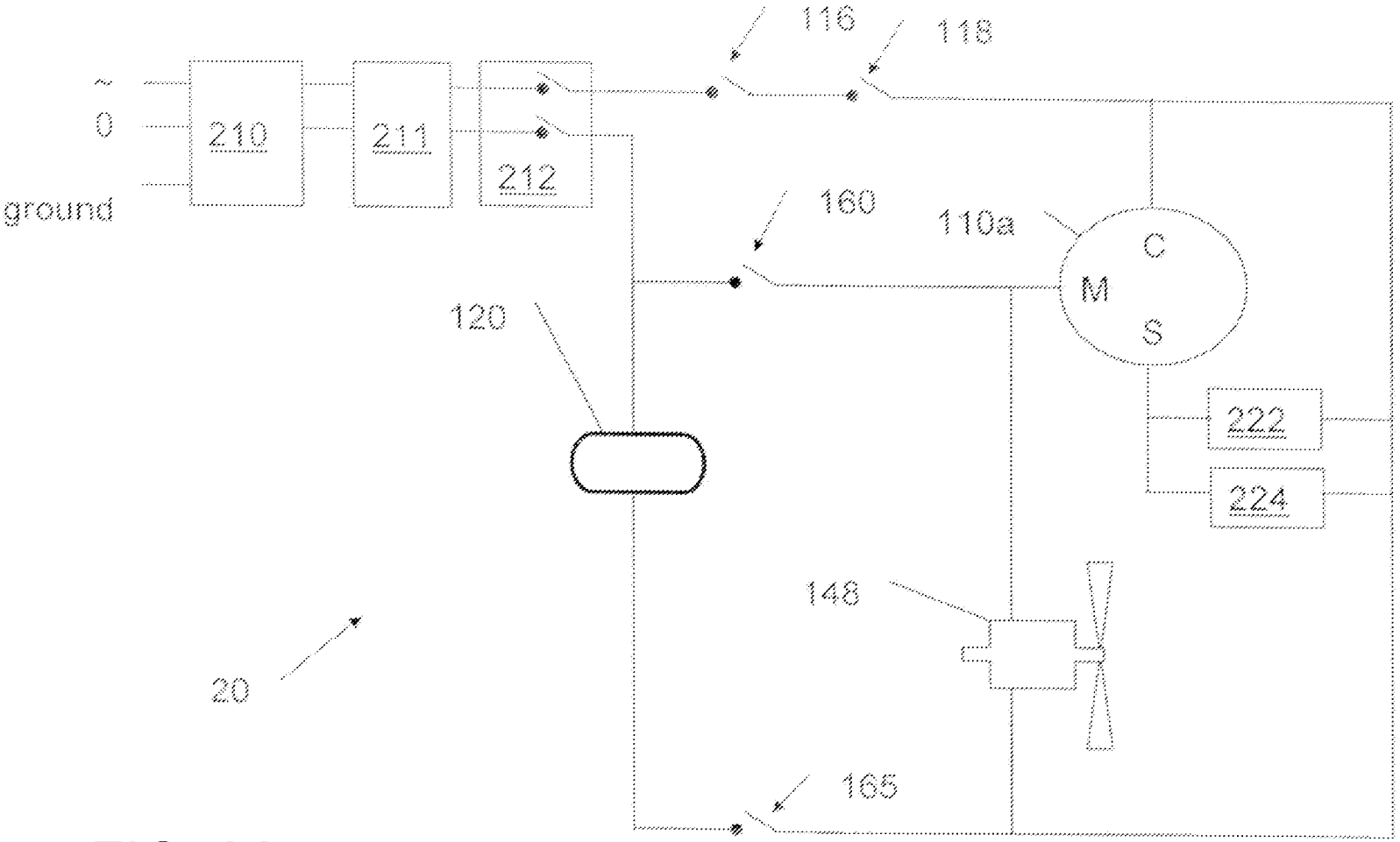
FIG. 2A is a schematic electric diagram of the heating system according to an illustrative single-phase embodiment.

FIG. 2A depicts a schematic electric diagram 20 of a single phase powered heating pool heating system 10 according to an illustrative embodiment. The power line can include a main single phase "~", a neutral line "0," and a ground line that can be connected to the outdoor unit 12. The enclosure of the outdoor unit 12 can be grounded. In some embodiments, a ground fault circuit interrupter GFCI 210 can be used to protect against main to ground current leaks while an over current fuse 211 can be used to protect against main to neutral shorts and motor overheating. In some embodiments, a main switch 212 can be included as well. The main switch 212 can be used to provide a power shutoff and/or a switch for activating the power connection. It should be clear that the order of these components can be changed, that fuses 211 or 210 may be used as total power disconnects, and that timers (not shown), fuses, and/or switches also can be housed outside the outdoor unit enclosure.

A compressor 110A and a fan 148 can be powered when the high pressure shutoff switch 116, the low-pressure shutoff switch 118, and the water thermal sensor 160 switch are all in a closed position. It should be understood that this embodiment is illustrative, and should not be construed as being limiting in any way. An S.P.5 capacitor 222 and a 20-microfarad capacitor 224 can be connected between the S and C terminals of the compressor motor, if desired. A solenoid-controlled reversible valve 120 state can depend on the position of the condenser thermal sensor 165. It should be noted that the compressor 110A and 110B in FIGS. 2A-3B can be variable capacity compressors.

Figure 2B:
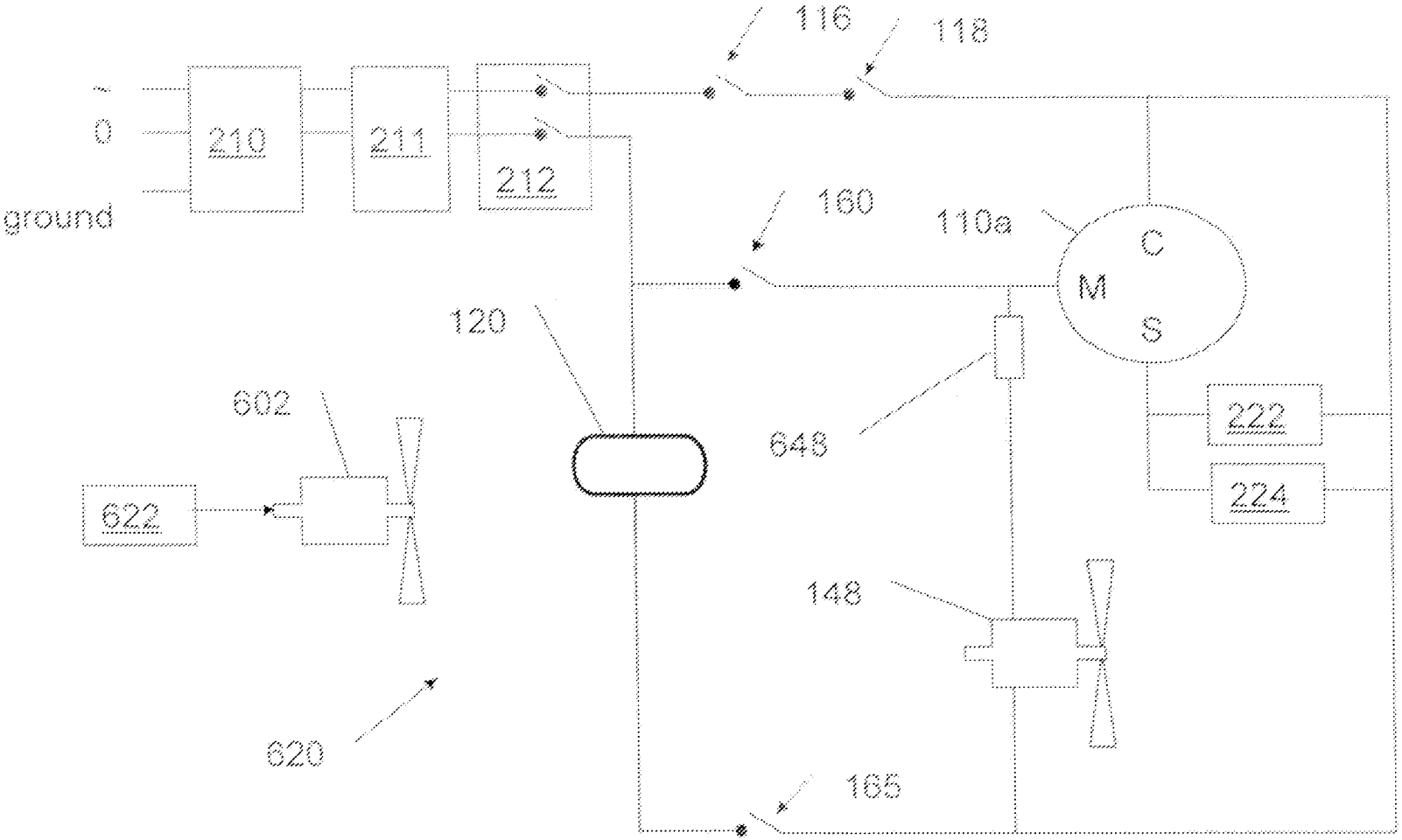
FIG. 2B is a schematic electric diagram of the heating system according to another illustrative single-phase embodiment.

FIG. 2B depicts a schematic electric diagram 620 of a single phase powered heating system according to another illustrative embodiment. The schematic electric diagram 620 differs from the electric diagram 20 of FIG. 2A by including several optional modifications. In particular, the embodiment illustrated in FIG. 2A includes a rheostat 648. The rheostat 648 can be used to control operation of the fan 148. The rheostat 648 can be a variable transformer such as a variac. The rheostat 648 also can be a coil restricting the current through the fan 148, a dimmer, or any other electrical controller for controlling operation of the fan 148. It should be understood that these embodiments are illustrative, and should not be construed as being limiting in any way. It should be understood that changing output of the fan 148 according to heating load of the system 620, for example seasonally, according to the ambient/outdoor temperature, according to the heating load, and/or for other reasons can reduce energy consumption and wear of the motor, thus reducing operation costs. The electric diagram 620 also shows the water pump 602 with its electrical controller 622, which is described above with reference to FIG. 1B.

Figure 3A:
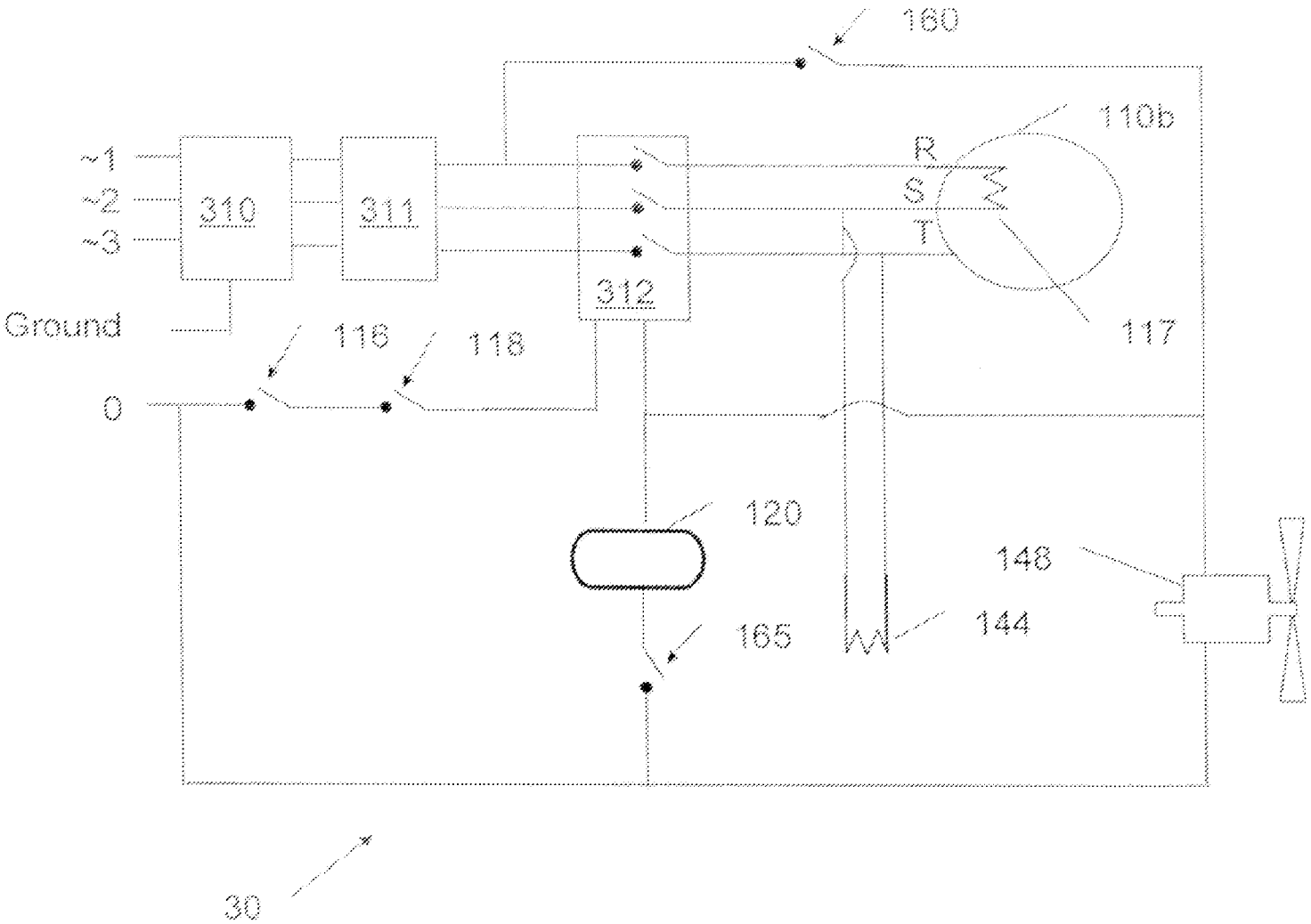
FIG. 3A is a schematic electric diagram of the heating system according to an illustrative three-phase embodiment.

FIG. 3A depicts a schematic electric diagram 30 of a three phase powered heating pool heating system 10 according to an illustrative embodiment. The electric diagram 30 illustrates a power line having three main phases "~1, ~2, ~3," a neutral line "0," and a ground line that is connected to the outdoor unit 12. As noted above, the enclosure of the outdoor unit 12 can be grounded. In some embodiments, a GFCI fuse 310 is used to protect against main to ground current leaks while an over current fuse 311 is used to protect against main to neutral shorts and motor overheating. In some embodiments, a main switch (not shown) may be used for total power disconnection. It should be clear that the order of these components may be changed, that fuses 311 or 310 may be used as total power disconnects, and that timers (not shown in this drawing), fuses, switches, or other elements may be housed outside the outdoor enclosure.

In the illustrated embodiment, the compressor 110*b* has a three-phase motor having terminals marked "R, S, T." The compressor 110*b* may further include a heating element 117. The heating element 117 can be connected to terminals R and S of the compressor 110*b*, if desired. According to various implementations, capacitors are unnecessary for this type of motor and therefore are not shown in FIG. 3A. In some embodiments, the compressor 110*b* and the fan 148 are powered only when the high pressure shutoff switch 116, the low-pressure shutoff switch 118, and the water thermal sensor 160 switch are all in a closed position, though this is not necessarily the case. In some embodiments, however, the compressor 110*b* is powered by relay closing of a contractor 312. A solenoid controlled reversible valve 120 state can depend on the position of the condenser thermal sensor 165. It should be understood that these embodiments are illustrative, and should not be construed as being limiting in any way.

Figure 3B:
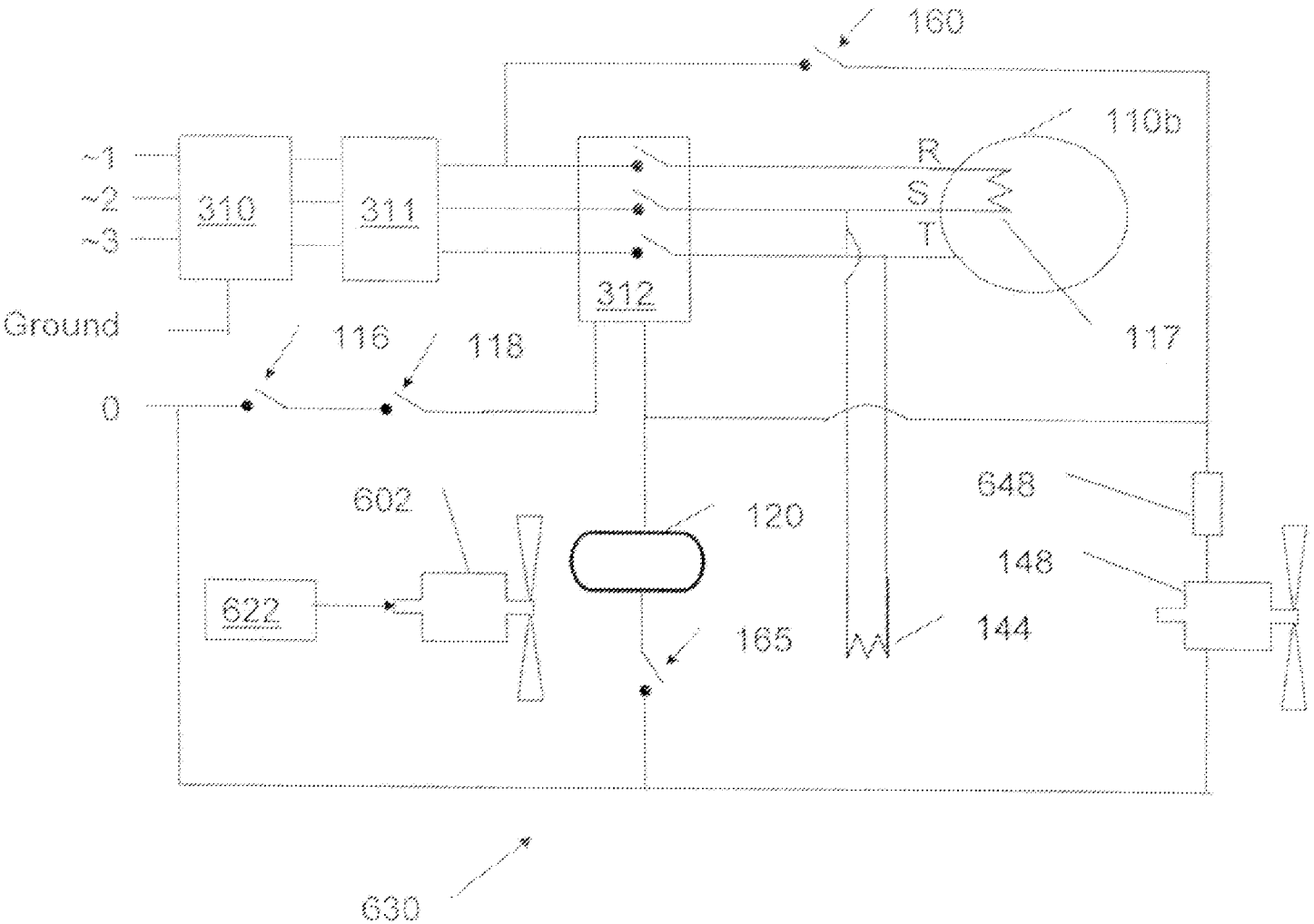
FIG. 3B is a schematic electric diagram of the heating system according to another illustrative three-phase embodiment.

FIG. 3B depicts a schematic electric diagram 630 of a three phase powered heating system according to another illustrative embodiment. The schematic electric diagram 630 differs from electric diagram 30 of FIG. 3A by including various optional modifications. In particular, an optional rheostat 648 is shown. The rheostat 648 can be used to control the operation of the fan 148. The rheostat 648 can be a variable transformer such as a variac, a coil restricting the current through fan 148, a dimmer, and/or any other suitable controller for controlling the operation of the fan 148. Changing output of the fan 148 according to heating load of the system 10, for example to adjust for seasonally changing weather conditions, according to the outdoor or ambient temperature, according to heating load, and/or for other reasons can help reduce energy consumption and wear of the motor, thus reducing operating costs. The electric diagram 630 also shows a water pump 602 with an electrical controller 622 as described above with reference to FIG. 1B. It should be understood that these embodiments are illustrative, and should not be construed as being limiting in any way.

Figure 4:
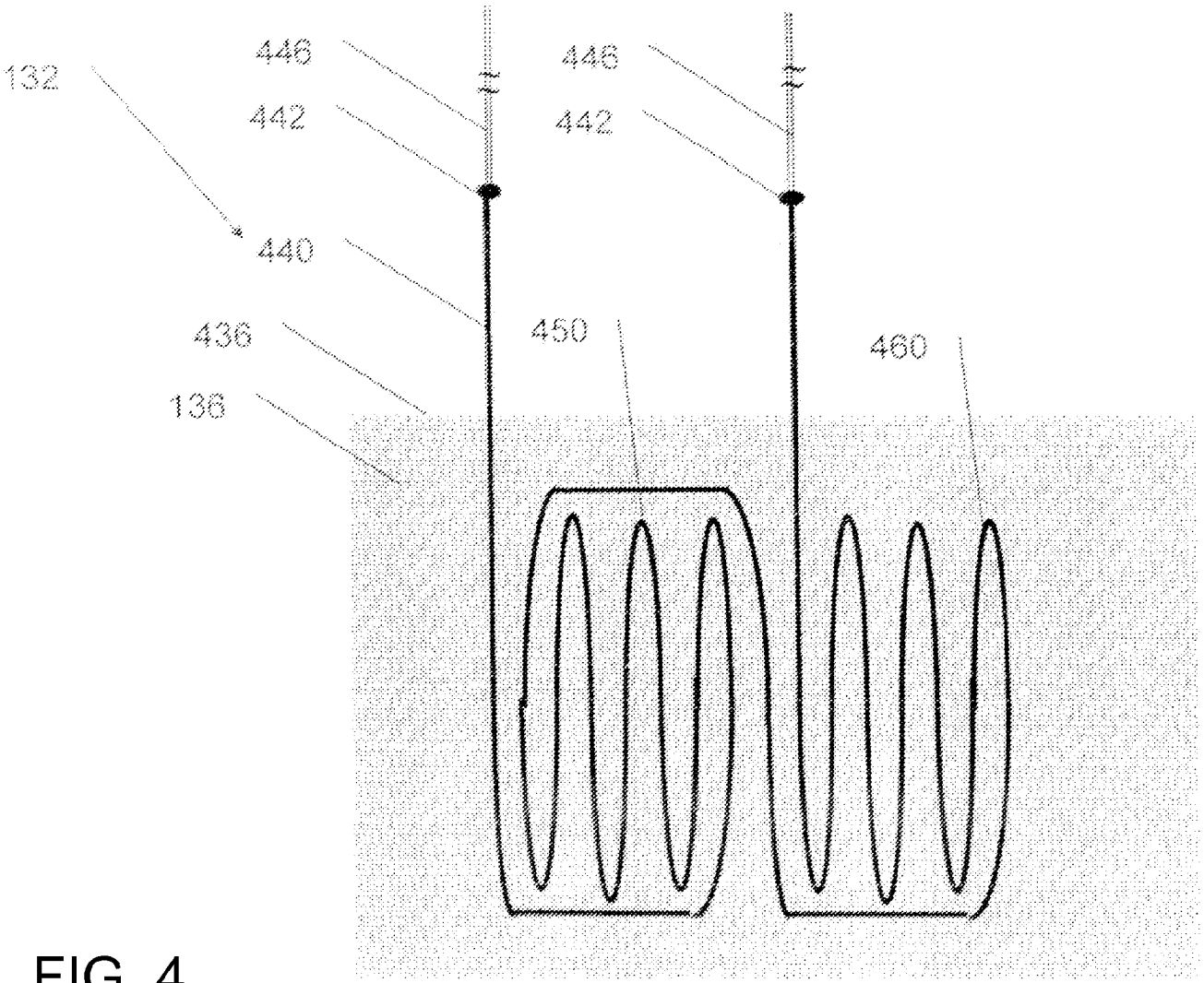
FIG. 4 is an illustration of the immersed condenser coil according to illustrative embodiment.

FIG. 4 depicts some details of the immersed condenser coil 132 according to one illustrative embodiment. In some embodiments, using corroding materials such as copper, steel, iron, aluminum, or other metals may cause coloration of the water 136 in the pool 134, for example, due to chemical reactions between the water 136 and disinfecting agents such as chlorine used for maintaining pool hygiene. In some embodiments, corrosion-resistant or corrosion-proof materials are used to form the immersed condenser coil 132. In some embodiments, the immersed condenser coil 132 is formed from stainless steel tubing.

In some embodiments, the steel tubing used to form the immersed condenser coil 132 has an inner diameter of 12.8 mm and an outer diameter of 16.0 mm. It should be understood that although diameters are listed herein, the concepts and technologies disclosed herein are not so limited. More particularly, there is almost no limit on sizes and/or diameters of components used in accordance with the concepts and technologies disclosed herein aside from space considerations and capacity requirements, both of which can be considered when sizing the pool heating system 10 according to various embodiments disclosed herein. The immersed condenser coil 132 can be made by bending stainless steel pipe 440 into a number of coils. In some embodiments, the coils include two or more flat coils. It should be understood that this embodiment is illustrative, and should not be construed as being limiting in any way. In other embodiments, a copper-nickel alloy is used instead of or in addition to stainless steel.

In the illustrated embodiment, a front coil 450 and a back coil 460 are immersed in the water 136. As such, the front coil 450 and the back coil 460 are below the water level 436. In some embodiments, the back coil 460 is mounted near the wall of the pool, and the front coil 450 is mounted in front of the back coil 460. It should be understood that this embodiment is illustrative, and should not be construed as being limiting in any way. The stainless steel pipe 440 can be connected to copper pipes 446, which can lead to the outdoor unit 12 using connectors 442 that are above the water level 436, if desired.

Figure 5:
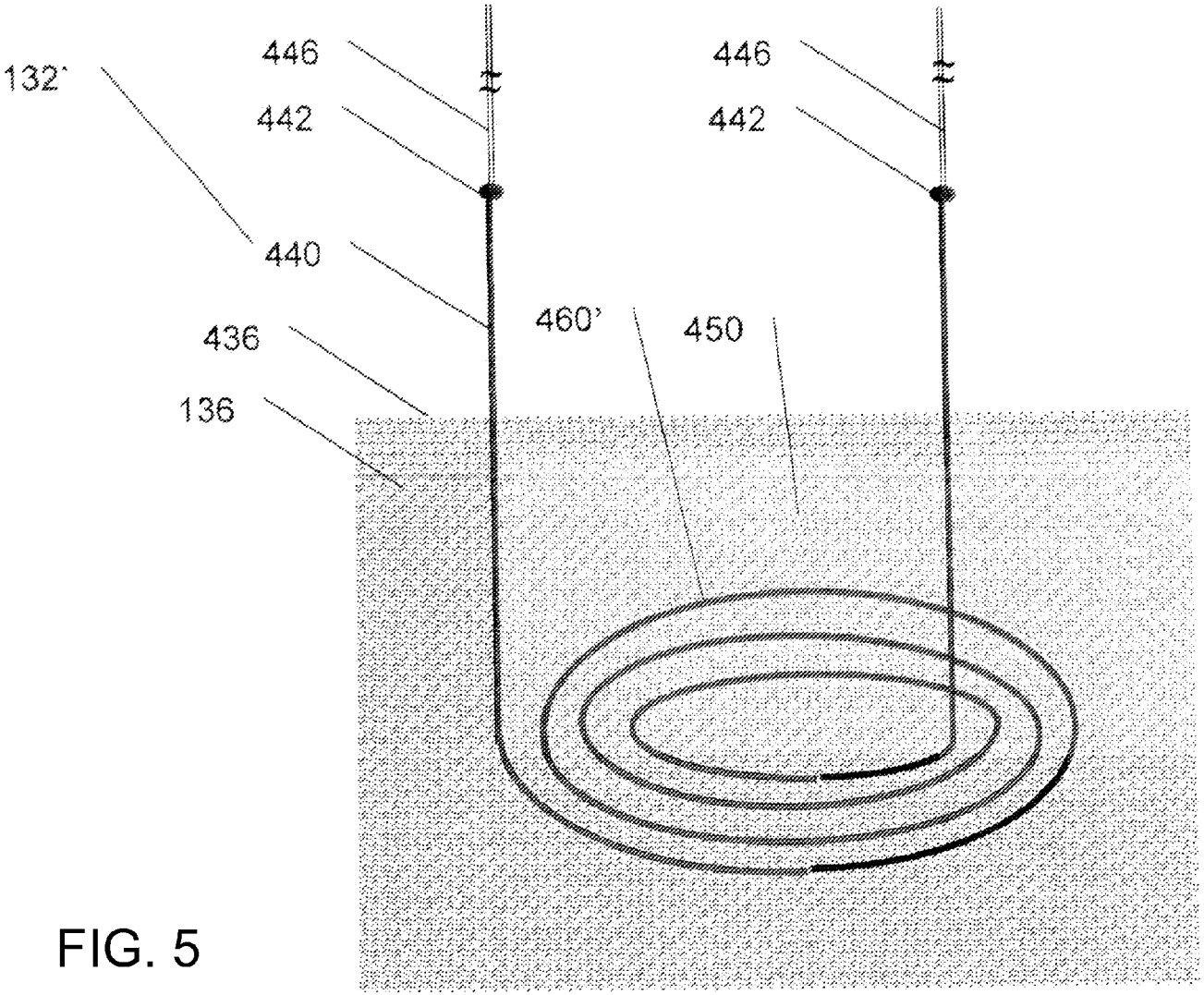
FIG. 5 is an illustration of the immersed condenser coil according to another illustrative embodiment.

FIG. 5 depicts some details of an alternative immersed condenser coil 132' according to another illustrative embodiment. The immersed condenser coil 132' of FIG. 5 is similar to the immersed condenser coil 132 shown in FIG. 4, but differs from the immersed condenser coil 132 depicted in FIG. 4 at least with respect to several modifications shown in FIG. 5. In particular, the front coil 450 and the back coil 460 shown in FIG. 4 are replaced in the embodiment shown in FIG. 5 with a serpentine coil 460'. A number of turns of the serpentine coil 460' may vary based upon design needs and/or preferences. Additionally, the serpentine coil 460' can be configured in layers similar to the configuration illustrated in FIG. 2. Alternatively, the serpentine coil 460' can be configured in layers stacked vertically. It should be understood that these embodiments are illustrative, and should not be construed as being limiting in any way.

Figure 6:
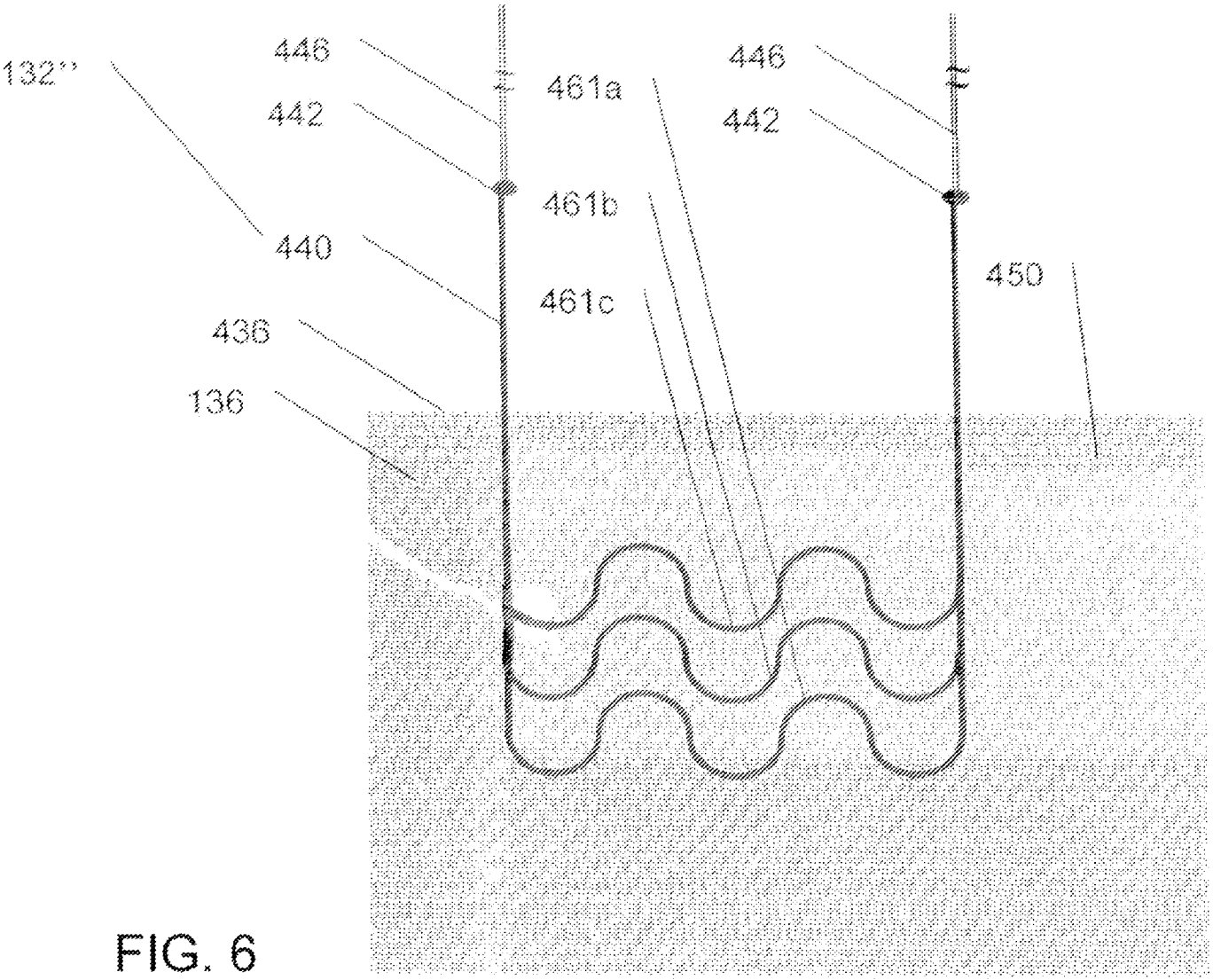
FIG. 6 is an illustration of the immersed condenser coil according to yet another illustrative embodiment.

FIG. 6 depicts some details of another alternative immersed condenser coil 132" according to yet another illustrative embodiment. The immersed condenser coil 132" illustrated in FIG. 6 is similar in certain respects to the immersed condenser coils 132, 132' illustrated in FIGS. 4 and 5, respectively. The immersed condenser coil 132", however, differs from the embodiments illustrated in FIGS. 4-5 at least with respect to several modifications shown in FIG. 6. In particular, in the depicted illustrative embodiment shown in FIG. 6, the front Coil 450 and the back coil 460 of FIG. 4, and/or the serpentine coil 460' of FIG. 5 are replaced by a number of coils 461*a*, 461*b*, and 461*c*, wherein the coils 461*a*, 461*b*, 461*c* are illustrated as being connected in parallel with respect to one another. Although the three parallel coils 461*a*, 461*b*, 461*c* are shown in FIG. 6, it should be understood that one coil, two coils, or more than three coils can be used in various implementations. Furthermore, it should be understood that the coils 461*a*, 461*b*, 461*c* may be replaced with straight pipes, may be coiled in one layer, two layers, or more than two layers as depicted in FIG. 4, configured as a serpentine coil 460' as shown in FIG. 5, or combinations thereof.

Other embodiments of the concepts and technologies disclosed herein will now be described. In some embodiments, the various pipes and/or tubing described herein are replaced with flexible stainless steel pipes. For example, flexible stainless steel pipes having an inside diameter of about three-eighths inches, about one half inch, and/or other diameters are used. It should be understood that although diameters are listed herein, the concepts and technologies disclosed herein are not so limited. More particularly, there is almost no limit on sizes and/or diameters of components used in accordance with the concepts and technologies disclosed herein aside from space considerations and capacity requirements, both of which can be considered when sizing the pool heating system 10 according to various embodiments disclosed herein. Similarly, the immersed condenser coil 132, 132', 132" can be formed from one or more alloys of copper and nickel. The immersed condenser coil 132, 132', 132" can be poured or formed with a mixture of light metals and coated with one half millimeter or other thicknesses of stainless steel. In some embodiments, the stainless steel used to coat the immersed condenser coil 132, 132', 132" formed from the light metal is formed from stainless steel 314, stainless steel 316, and/or other types or alloys of stainless steel. It should be understood that these embodiments are illustrative, and should not be construed as being limiting in any way.

Various components can be added to the various embodiments of the pool heating systems disclosed herein. For example, some embodiments of the pool heating system 10 include water filters and/or water pumps, flow switches, housings or enclosures, and/or other structures. In some embodiments, the pipes and/or lines described herein are located within a plastic housing. In some embodiments, the plastic housing is provided by a plastic flexible pipe. One embodiment of the flexible plastic pipe is illustrated in FIG. 7.

Figure 7:
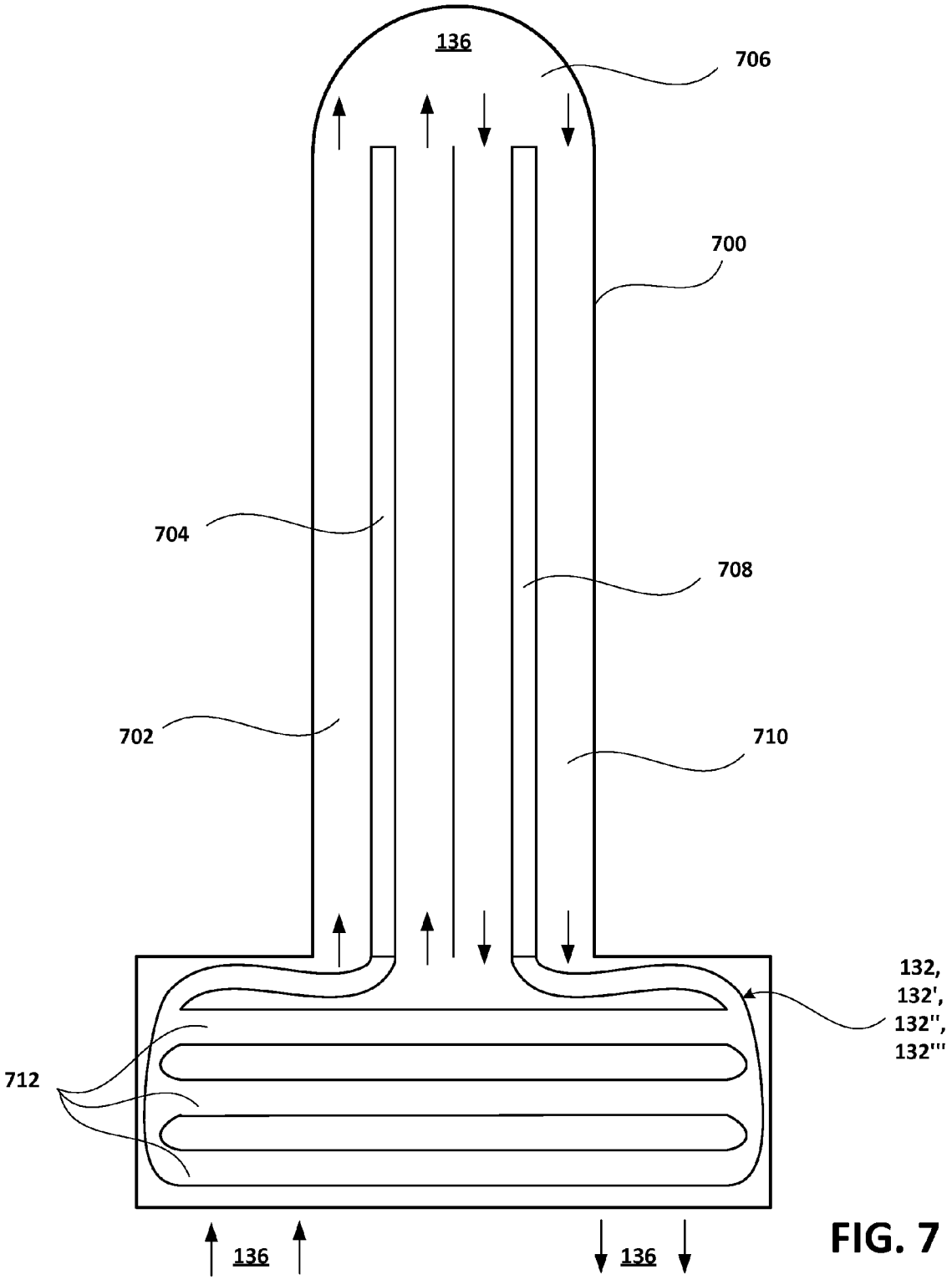
FIG. 7 is a line drawing illustrating a view of a heating system, according to various illustrative embodiments.

As shown in FIG. 7, a plastic assembly 700 is provided. The plastic assembly is formed around the immersed condenser coil 132, 132', 132", 132'''. Water 136 from a pool 134 or other body of water enters the plastic assembly 700. The plastic assembly 700 includes or is connected to a send pipe 702. In some embodiments, the send pipe 702 is formed from a flexible plastic and houses a flexible stainless steel pipe that functions as a send line 704 for the immersed condenser coil 132, 132', 132", 132'''. The water 136 travels along the send line 704 and is heated by the send line 704 within the flexible plastic send pipe 702.

The now-heated water 136 can reverse flow at a junction 706 and can be returned to the pool 134 via a return pipe 708 that is connected to or a part of the plastic assembly 700. A return line 710 can be located within the return pipe 708, via which the hot refrigerant from the immersed condenser coil 132, 132', 132", 132''' is returned to the evaporator, compressor, and/or other components of the pool heating system 10. Thus, the water 136 within the return pipe 708 can be further heated by the refrigerant, thus increasing the time for which the water 136 contacts the heated refrigerant. As such, some embodiments of the concepts and technologies disclosed herein provide additional heating capabilities for the pool heating system 10 without increasing electricity usage, pool heating system footprints, and/or operating costs. It should be understood that these embodiments are illustrative, and should not be construed as being limiting in any way.

Although not shown in FIG. 7, it should be understood that the send line 704 and the return line 710 can extend past the junction 706 and therefrom back to the outdoor unit 12 and/or to other structures and/or devices. Also, while not shown in FIG. 7, high pressure suction devices and/or pump devices can be located at or near the junction, thereby creating suction to pull water 136 into the send pipe 702 and/or to return the water 136 back to the pool 134 via the return pipe 708. Also, a temperature sensor can be used to detect temperature of the water 136 at the junction 706 via a flow line from the junction 706 to a sensor. Also, the flow line can be used to generate the pressure or suction via an inlet line from the junction 706. Thus, in some embodiments an inlet line from the junction 706 is tied to a flow switch as described herein, and therefrom to a water pump and/or filter. The flow switch can be controlled by a temperature sensor disposed at any suitable location including, but not limited to, the junction 706, near the plastic assembly 700, These components are not illustrated in FIG. 7 to avoid clouding the disclosure. As such, the illustrated embodiments are illustrative and should not be construed as being limiting in any way.

As shown in the illustrated embodiment, the immersed condenser coil 132, 132', 132", 132''' can include an embodiment of the immersed condenser coil 132, 132', 132", 132''' not shown in the previous FIGURES. In particular, the immersed condenser coil 132, 132', 132", 132''' can include any number of radiator members 712. In the illustrated embodiment, the immersed condenser coil 132, 132', 132", 132''' includes three radiator members 712. It should be understood that this embodiment is illustrative, and should not be construed as being limiting in any way.

The radiator members 712 are configured to provide even more efficient heating of the water 136 relative to some other designs. Although the immersed condenser coil 132, 132', 132", 132''' is described as having radiator members 712, it should be understood that the immersed condenser coil 132, 132', 132", 132''' can be poured or formed as a single component. In some embodiments, for example, the immersed condenser coil 132, 132', 132", 132''' is formed from a single piece of copper nickel. In other embodiments, the immersed condenser coil 132, 132', 132", 132''' is formed from a single piece of stainless steel. The steel can include, but is not limited to, type 314 stainless steel, type 316 stainless steel, and/or other types of steel. Additionally, the immersed condenser coil 132, 132', 132", 132''' can be formed from aluminum and/or other alloys or metals, and can be treated or coated with stainless steel, anodized coatings, plastics, nickel, and/or any other suitable materials. According to various embodiments, the immersed condenser coil 132, 132', 132", 132''' can be configured to withstand pressures of up to 320 pounds per square inch, between 320 and 335 pounds per square inch, and/or 335 pounds per square inch or more. The immersed condenser coil 132, 132', 132", 132''' can be formed from any suitable materials and/or shapes, and therefore it should be understood that these embodiments are illustrative, and should not be construed as being limiting in any way.

In some embodiments, the pool heating system 10 includes a hygrometer for activating a dehumidifier, the fan 148, and/or other structures or devices for reducing humidity an area around the pool heating system 10, if desired. Thus, the fan 148 or other devices or structures can have a default operating mode or speed, and a second mode or speed that is activated by the hygrometer. It should be understood that this embodiment is illustrative, and should not be construed as being limiting in any way.

In some embodiments, the pool heating system 10 is configured to perform a cleaning operation. In some embodiments, the cleaning operation is a self-cleaning operation. The pool heating system 10 can include a timer between the main power line and the relay. A plasticized or enameled reservoir is placed into the pool 134. It should be understood that these embodiments are illustrative, and should not be construed as being limiting in any way.

In some embodiments, an illustrative method for cleaning the pool heating system 10 includes at least the following operations. The pool 134 is drained of the water 136. The plasticized or enameled reservoir can be kept full of water 136 despite draining the pool 134, or the reservoir can be filled with water after emptying the pool 134.

A cleaner can be put into the reservoir. In some embodiments, a decalcifying agent such as stereo acid powder, citric acid, muriatic acid, and/or other materials can be placed in the reservoir and the pool heating system 10 can be activated to heat the immersed condenser coil 132, 132', 132", 132''' during heating. In some embodiments, the decalcifying agent is placed into the water 136 in the reservoir during the first five to ten minutes of heating. The immersed condenser coil 132, 132', 132", 132''' can be left in the reservoir with the decalcifying agent with the heating on or off for two to three hours, after which the immersed condenser coil 132, 132', 132", 132''' is clean. The reservoir is emptied and the pool is refilled for normal operation. It should be understood that this embodiment is illustrative, and should not be construed as being limiting in any way.

In some embodiments, a mobile model of the pool heating system 10 is provided. The outdoor unit 12 can be placed into a plastic, metal, or other suitable enclosure ("base"). It should be understood that other components of the pool heating system 10 can be located with the base, if desired.

The base can be reinforced with steel or other metals, or with plastics, thermoplastics, and/or other reinforcing members, structures, or materials. The base is equipped with wheels and/or brakes. The mobile model of the pool heating system can include other structures such as the plastic assembly 700 illustrated above with respect to FIG. 7. Thus, a double layer pipe having an outer plastic pipe or housing and an inner steel or other material pipe can be included in the mobile model.

A connection between a pool and a water pump can be achieved and two bimetal security thermostats (or one double thermostat) can be located in the connection. The mobile pool heating system 10 can be electrically connected in parallel to a power relay, with a two contact interrupter limiting operation to a range between 40 C and 70 C. The pipe to inlet can be immersed one to two feet in the water 136 such as the pool 134. The double layer pipe is connected to the water pump outlet and the water surface in the pool 134. The mobile model of the pool heating system 10, aside from being mobile, allows increased water heating efficiency, thereby reducing energy usage relative to other pool heating systems. The mobile model of the pool heating system 10 also can thermally protect various components, thereby preventing freezing and burning of users. The mobile model of the pool heating system 10 also can increase the effects of the mobile model of the pool heating system 10 by spreading the heated water to improve convection of the heated water throughout the pool 134.

Experiments performed using embodiments of the concepts and technologies disclosed herein, have been shown to heat water and/or pools of water to high temperatures. For example, embodiments of the concepts and technologies disclosed herein have been used to heat a pool of water to over seventy degrees Celsius. As such, embodiments of the concepts and technologies disclosed herein may be used for heating water for showers, for hand washing, and/or for other uses. In some embodiments, water is heated to a high temperature using the concepts and technologies disclosed herein by heating the water and storing the heated water in a thermally insulated enclosure. It should be understood that these embodiments are illustrative, and should not be construed as being limiting in any way.

Based on the foregoing, it should be appreciated that pool heating systems and methods for making pool heating systems have been disclosed herein. Although the subject matter presented herein has been described in language specific to various methods and structures, it is to be understood that the invention defined in the appended claims is not necessarily limited to the specific methods, acts, or structures described herein. Rather, the specific methods, acts, and/or structures are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the embodiments, which is set forth in the following claims.

I claim:

1. A pool heating system comprising:

an immersed condenser coil immersed in pool of water, the immersed condenser coil receiving hot refrigerant gas at high pressure from an outdoor unit, transferring heat to water in the pool, condensing the gas, and transmitting condensed refrigerant to the outdoor unit; and the outdoor unit, wherein the outdoor unit comprises an air-conditioning unit including a condenser and an evaporator, wherein the outdoor unit operates by flowing the refrigerant in a reverse direction relative to a normal flow direction for the air-conditioning unit to operate the condenser of the air-conditioning unit as an evaporator for the outdoor unit, and to operate the evaporator of the air-conditioning unit as a condenser for the outdoor unit, and wherein the outdoor unit comprises:

a compressor that compresses refrigerant gas to produce compressed hot refrigerant gas; a compressor heating element that heats a portion of the compressor to maintain an operating temperature of the compressor at a defined temperature range; a hot gas bypass valve located between an inlet through which the refrigerant gas enters the compressor and an outlet through which the hot refrigerant gas exits the compressor; an expansion valve receiving and expanding condensed refrigerant from the immersed condenser coil to produce a low-pressure cold mixture of gaseous and liquid refrigerant; the evaporator, wherein the evaporator evaporates the cold low-pressure cold mixture of gaseous and liquid refrigerant to produce low-pressure refrigerant gas, and wherein the evaporator transmits the low-pressure refrigerant gas to the compressor; an evaporator heating element that heats the evaporator, wherein the evaporator is activated based upon a condenser thermal sensor in contact with the evaporator, and wherein the evaporator heating element heats the evaporator in cold conditions; a hygrometer that detects an ambient humidity at the pool heating system and activates a dehumidifier to reduce humidity at an area proximate to the pool heating system; a timer that activates and deactivates the pool heating system to activate or deactivate heating of the pool; a low-pressure shutoff switch; a high pressure shutoff switch connected to the outlet, wherein the high pressure shutoff switch deactivates the pool heating system if a pressure in the pool heating system deviates from one or more predefined pressure ranges or pressure thresholds; a rheostat; and a fan that blows air over the evaporator to transfer heat to the low-pressure cold mixture of gaseous and liquid refrigerant, and to evaporate the low-pressure cold mixture of gaseous and liquid refrigerant, wherein the fan is activated by at least one of the rheostat or the dehumidifier, wherein a rotational speed of the fan is increased or decreased based upon the rheostat or the dehumidifier, and wherein the fan and the compressor are activated only when the high pressure shutoff switch and the low-pressure shutoff switch are in closed positions.

2. The pool heating system of claim 1, wherein the immersed condenser coil is made of stainless steel.

3. The pool heating system of claim 1, further comprises of a thermostat for controlling the operation of the heating system by turning on and turning off the compressor, wherein the thermostat is immersed in the pool.

4. The pool heating system of claim 1, further comprising:

a reversible valve for reversing the direction of refrigerant, activated during defrost mode and directing hot high pressure gas from the compressor to the evaporator and low-pressure gas from the condenser to the compressor;

a bi-directional expansion valve capable to expand and cool gas flowing from both directions; and an evaporator temperature sensor attached to the evaporator, wherein the evaporator temperature sensor senses an evaporator temperature and activates a defrost mode when the evaporator temperature is 4° C. or colder.

5. The pool heating system of claim 1, further comprising a water pump, wherein the water pump mixes water in the pool of water.

6. The pool heating system of claim 1, wherein the compressor is a variable capacity compressor.

7. The pool heating system of claim 1, further comprising a controller for controlling rotation speed of the fan.

8. The pool heating system of claim 1, further comprising a liquid separator for maintaining compressor intake pressure.

9. The pool heating system of claim 1, wherein the immersed condenser coil has a serpentine shape.

10. The pool heating system of claim 1, further comprising at least one additional immersed condenser coil connected in parallel to the immersed condenser coil.

11. The pool heating system of claim 1, wherein the pool comprises a mikvah, and wherein the mikvah contains less than three metric tons of water.

12. The pool heating system of claim 11, wherein the timer deactivates the pool heating system on the Sabbath.

* * * * *